US006130294A

United States Patent [19]

Ichikawa et al.

[11] Patent Number: 6,130,294

[45] **Date of Patent: *Oct. 10, 2000**

[54] GOLF BALL

[75] Inventors: Yasushi Ichikawa; Yoshinori Egashira; Shunichi Kashiwagi, all of Chichibu, Japan

[73] Assignee: Bridgestone Sports Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/873,594

[22] Filed: Jun. 12, 1997

[30] Foreign Application Priority Data

Jun. 14, 1996 [JP] Japan ..... 8-175517

[51] Int. Cl.[7] ..... A63B 37/12

[52] U.S. Cl. ..... 525/221; 525/196; 525/201; 473/372; 473/378; 473/385

[58] Field of Search ..... 525/196, 201, 525/221; 473/372, 378, 385

[56] References Cited

U.S. PATENT DOCUMENTS

| | | | |
|---|---|---|---|
| 5,298,571 | 3/1994 | Statz | 525/196 |
| 5,397,840 | 3/1995 | Sullivan | 525/196 |
| 5,688,869 | 11/1997 | Sullivan | 525/196 |
| 5,691,418 | 11/1997 | Hagman | 525/196 |

FOREIGN PATENT DOCUMENTS

| | | | |
|---|---|---|---|
| 24204 | 10/1994 | WIPO | 525/221 |
| 9500212 | 1/1995 | WIPO | 525/221 |

*Primary Examiner*—David J. Buttner
*Attorney, Agent, or Firm*—Sughrue, Mion, Zinn, Macpeak & Seas, PLLC

[57] ABSTRACT

In a golf ball comprising a core and a cover, the cover is composed mainly of a blend of a soft ionomer in the form of a magnesium ion neutralized ethylene/(meth)acrylic acid/acrylate terpolymer and a hard ionomer in the form of a magnesium ion neutralized ethylene/(meth)acrylic acid copolymer. The blend has a Shore D hardness of 44–60. The ball is minimized in restitution loss and has an increased initial velocity, spin receptivity, good hitting feel, and scuff resistance.

20 Claims, No Drawings

GOLF BALL

TECHNICAL FIELD

This invention relates to a golf ball comprising a core and an ionomer cover.

BACKGROUND

As the cover stock of two-piece golf balls and some wound golf balls, ionomer resins in the form of ethylene/(meth)acrylic acid copolymers have been widely used and accepted because of their long-lasting impact resistance and cut resistance. Since the ionomer resins provide hard hitting feel and high hardness as compared with the balata rubber conventionally used as the cover stock, ionomer covered golf balls are difficult to impart a desired spin rate and inferior to control on iron shots.

For improvements in these respects, Sullivan, U.S. Pat. No. 4,884,814 or JP-A 308577/1989 proposes to blend a hard ionomer resin in the form of a zinc or sodium salt of an ethylene/(meth)acrylic acid copolymer having a certain spectrum of physical properties with a specific amount of a soft ionomer resin in the form of a zinc or sodium salt of an ethylene/(meth)acrylic acid/(meth)acrylate terpolymer. The soft/hard ionomer blend is used as a golf ball cover. This technique is quite effective for improving the hitting feel and control of golf balls using a conventional ionomer resin in the form of an ethylene/(meth)acrylic acid copolymer as the cover.

Nevertheless, the golf ball cover made of the above-mentioned blend of soft and hard ionomers of zinc or sodium salt type has several problems. Since the soft ionomer resin in the form of a zinc or sodium salt of an ethylene/(meth)acrylic acid/(meth)acrylate terpolymer is less resilient, the cover which is made softer using this soft ionomer resin is significantly reduced in restitution. In the manufacturing process, a molded part of this blend can be surface roughened by deburring and surface polishing because ionomers neutralized with different metal ions are less compatible with each. The cover becomes soft and improved in spin characteristics for the reason that the area of the ball in contact with the club upon iron shots is increased, which allows the cover surface to be scraped off by grooves across the iron club face, giving rise to the problem, known as a scuffing phenomenon, that the ball surface becomes fluffy. That is, the low compatibility between ionomers neutralized with different metal ions in a blend leads to a lowering of scuff resistance.

It is noted that U.S. Pat. No. 4,884,814 also discloses a blend of ionomers neutralized with the same metal ion, that is, a blend of sodium ion neutralized ionomers or a blend of zinc ion neutralized ionomers. According to our follow-up test, a blend of ionomers neutralized with the same metal ion as disclosed in this U.S. patent failed to provide a good balance of hitting feel (soft feel) and restitution.

SUMMARY OF THE INVENTION

An object of the invention is to provide a novel and improved golf ball which is minimized in restitution loss, improved in feel, spin receptivity, control, scuff resistance upon iron shots, and manufacturing yield.

It is desirable that ionomer covered golf balls have soft feeling, good spin receptivity, and improved scuff resistance upon iron shots while they can be manufactured in high yields. We have found that when the golf ball cover is formed of a blend of soft/hard ionomers, a golf ball using a magnesium ion neutralized ionomer as the soft ionomer in the cover is apparently improved in restitution, without altering soft feel and spin, over those balls using other metal ion neutralized ionomers as the soft ionomer. We have also found that compatibility is improved by using a magnesium ion neutralized ionomer as the hard ionomer, that is, using soft and hard ionomers neutralized with the same metal ion species. The improved compatibility is effective for minimizing surface roughening by surface polishing subsequent to deburring in the manufacturing process and surface damage by iron shots.

According to the invention, there is provided a golf ball comprising a core and a cover, the cover predominantly comprising a blend of a first ionomer in the form of a magnesium ion neutralized ethylene/(meth)acrylic acid/acrylate terpolymer and a second ionomer in the form of a magnesium ion neutralized ethylene/(meth)acrylic acid copolymer. The blend should have a Shore D hardness of 44 to 60, preferably 46 to 57.

BEST MODE FOR CARRYING OUT THE INVENTION

According to the present invention, the cover of the golf ball is composed mainly of a blend of (A) a soft ionomer in the form of a magnesium ion neutralized ethylene/(meth)acrylic acid/acrylate terpolymer and (B) a hard ionomer in the form of a magnesium ion neutralized ethylene/(meth)acrylic acid copolymer.

The blend should have a Shore D hardness of 44 to 60, especially 46 to 57. A golf ball having a cover of a blend with a Shore D hardness of less than 44 receives too much spin upon iron shots and has restitution and distance shortcomings. A golf ball having a cover of a blend with a Shore D hardness of more than 60 gives hard feel and receives less spin upon iron shots.

In one preferred embodiment of the invention, the golf ball cover is mainly formed from a blend of 10 to 90%, especially 25 to 75% by weight of the soft ionomer and 90 to 10%, especially 75 to 25% by weight of the hard ionomer. Less than 10% by weight of the soft ionomer would be insufficient to provide the cover stock with appropriate softness whereas appropriate hardness would be lost with more than 90% by weight of the soft ionomer.

The soft ionomer used herein is an ionomer resin in the form of a terpolymer of ethylene, (meth)acrylic acid and acrylate neutralized with a magnesium ion. The acrylate used herein includes esters having about 4 to about 12 carbon atoms, for example, methyl acrylate, ethyl acrylate, isobutyl acrylate, n-butyl acrylate, and 2-ethylhexyl acrylate, with n-butyl acrylate being preferred. Preferably the content of (meth)acrylic acid is 5 to 15% by weight, especially 7 to 12% by weight of the overall weight of the terpolymer and the content of acrylate is 5 to 45% by weight, especially 8 to 30% by weight of the overall weight of the terpolymer. A (meth)acrylic acid content of less than 5% by weight would lead to a loss of restitution whereas flexibility would be lost with a (meth)acrylic acid content of more than 15% by weight. An acrylate content of less than 5% by weight would fail to provide a fully flexible composition whereas an acrylate content of more than 45% by weight would provide a composition which is too flexible and less cut resistant. The (meth)acrylic acid of the terpolymer is neutralized with a magnesium ion to form an ionomer resin. The degree of neutralization is preferably 10 to 90 mol %, more preferably 30 to 80 mol %. Restitution would be insufficient with a degree of neutralization of less than 10 mol % whereas a degree of neutralization of more than 90 mol % would adversely affect flow during molding.

The hard ionomer used herein is an ionomer resin in the form of a copolymer of ethylene and (meth)acrylic acid neutralized with a magnesium ion. Preferably the content of (meth)acrylic acid is 10 to 20% by weight, especially 12 to 20% by weight of the overall weight of the copolymer. A (meth)acrylic acid content of less than 10% by weight would lead to a loss of restitution. The copolymer is neutralized with magnesium ion to form an ionomer resin. The degree of neutralization is preferably 10 to 70 mol %, more preferably 15 to 60 mol %. Restitution would be insufficient with a degree of neutralization of less than 10 mol % whereas a degree of neutralization of more than 70 mol % would adversely affect flow during molding and increase moisture absorption.

Since both the ionomers have a low melt flow rate (MFR), injection molding of their blend is sometimes difficult. The MFR of a blend can be increased by adding to the magnesium ion neutralized type ionomer of ethylene-(meth)acrylic acid copolymer a base polymer prior to metal ion neutralization for thereby reducing the degree of neutralization. The quantity or degree of dilution should preferably be selected in the range that would not impair the physical properties of the ionomer while it varies with the grade of ionomer. For example, Himilan AM7311 can be diluted by a factor of 2 without a loss of physical properties.

Many ionomer resins are commercially available under the trade name of Himilan from Mitsui-duPont Polychemical K.K. and Surlyn from E. I. dupont. Commercially available examples of the magnesium ion neutralized type ionomer of ethylene/(meth)acrylic acid/acrylate terpolymer, the magnesium ion neutralized type ionomer of ethylene/(meth)acrylic acid copolymer, and the base polymer thereof prior to magnesium ion neutralization which can be used in the cover are Surlyn AD8542, Himilan AM7311, and Nucrel 1560 as identified in Table 1, respectively. Note that Nucrel 1560 is the base polymer of Himilan AM7311.

TABLE 1

| Designation | Metal ion (wt %) | Acid content (wt %) | Ester content (wt %) | Degree of ionization (mol %) | Shore D hardness |
|---|---|---|---|---|---|
| Surlyn AD8542 | Mg | 10 | 24 | 50 | 44 |
| Himilan AM7311 | Mg | 15 | — | 54 | 62 |
| Nucrel 1560 | — | 15 | — | — | 50 |

Other than the magnesium ion neutralized type ionomers, commercially available examples of zinc, sodium and lithium ion neutralized type ionomers of ethylene/(meth) acrylic acid copolymers are Surlyn 7930, Himilan 1706 and Himilan 1605 as identified in Table 2, respectively. Commercially available examples of zinc and sodium ion neutralized type ionomers of ethylene/(meth)acrylic acid/acrylate terpolymers are Surlyn 9320 and Surlyn 8320 as identified in Table 2, respectively.

TABLE 2

| | Metal ion | Shore D hardness |
|---|---|---|
| Surlyn 7930 | Li | 63 |
| Himilan 1706 | Zn | 60 |
| Himilan 1605 | Na | 61 |
| Surlyn 9320 | Zn | 42 |
| Surlyn 8320 | Na | 37 |

The golf ball cover of the invention is made of a cover stock predominantly containing a blend of soft and hard ionomer resins as mentioned above while the cover stock may further contain various additives, for example, dyes, pigments (e.g., titanium dioxide, zinc oxide, and barium sulfate), UV absorbers, antioxidants, and dispersing aids (e.g., metal soaps). These ingredients are mixed in conventional mixers, for example, closed kneading machines (e.g., Banbury mixer and kneader), single and twin screw extruders and the resulting cover stock is molded by conventional procedures.

The golf ball of the invention is composed of a core enclosed with a cover of the above-mentioned cover stock. The core may be either a wound core or a solid core. The wound core may be either a liquid center core or a solid center core. The solid core may be a core of a two-piece golf ball or a core of a three or multi-piece solid golf ball.

The invention is applicable to not only two-piece golf balls consisting of a core and a single layer cover, but also three-piece golf balls having a two-layer cover and multi-piece golf balls. In the case of three-piece golf balls having a core enclosed with a two-layer cover, either the outer layer or the inner layer of the two-layer cover may be constructed of the above-mentioned cover stock. Where the cover stock of the invention is used as the outer layer of the two-layer cover, there is obtained a golf ball having improved scuff resistance. Where the cover stock of the invention is used as the inner layer of the two-layer cover, there is obtained a golf ball having improved restitution and soft feeling.

In the practice of the invention, a golf ball may be prepared by a conventional molding technique, for example, by molding a cover stock of the above-defined composition around a core. This molding may be accomplished by injection molding the cover stock around a core or by previously molding half shells from the cover stock, interposing a core between the half shells and effecting heat compression molding. The injection molding process is selected for solid cores. For wound cores, the compression molding process allowing for molding at relatively low temperature is preferred from the standpoint of the heat resistance of thread rubber.

In the golf ball of the present invention, the single layer cover preferably has a gage (or radial thickness) of 1.0 to 2.5 mm, more preferably 1.2 to 2.1 mm. A cover with a gage of less than 1.0 mm would lack cut resistance whereas a cover with a gage of more than 2.5 mm would result in a golf ball having short restitution. In the case of a multi-layer cover, the overall gage of the cover is 1 to 4 mm while the respective layers have a gage of 0.9 to 2.3 mm.

It is understood that the golf ball of the above mentioned construction should have a diameter and a weight meeting the Rules of Golf.

EXAMPLE

Examples of the present invention are given below by way of illustration and not by way of limitation. All parts are by weight.

Examples 1–10 and Comparative Examples 1–10

For the manufacture of two-piece golf halls, a solid core having a diameter of 38.7 mm was prepared by mixing the following ingredients, heat molding and curing the composition into a sphere.

| Solid core composition | Parts by weight |
|---|---|
| Cis-1,4-polybutadiene rubber (BR01 by Nippon Synthetic Rubber K.K.) | 100 |
| Zinc acrylate | 33.5 |
| Zinc oxide | 10 |
| Barium sulfate | 9.6 |
| Antioxidant | 0.2 |
| Dicumyl peroxide | 0.9 |

Cover stocks were prepared by mixing ionomer resins (Himilan and Surlyn) shown in Tables 1 and 2 in the ratio shown in Tables 3 and 4 and adding titanium dioxide, dispersant and optionally, barium sulfate thereto so as to give a specific gravity of 0.99. The cover stocks were injection molded over the solid core. The molded parts were deburred, surface polished and coated with clear paint. There were obtained two-piece solid golf balls having a cover gage of 2.0 mm, a diameter of 42.7 mm and a weight of 45.2 grams. The golf balls were examined by the following tests.

Hardness

Hardness is expressed by a distortion (mm) of a ball under a load of 100 kg. Higher values indicate softer balls.

Hitting Feel

Professional golfers actually hit the ball. The ball was rated "O" for soft feel, "Δ" for somewhat hard, acceptable feel, and "X" for hard feel and impact to the hands.

Initial Velocity

An initial velocity (m/s) was measured by an initial velocity meter of the type prescribed by USGA.

Scuffing by Iron

Three commercial pitching wedges were mounted on a robot machine. The ball was hit at three positions by the three pitching wedges, once at each position, at a head speed of 37 m/s. The three hit areas were visually observed. Evaluation was made according to the following criterion. The ball was rated "O" for very slight, substantially unperceivable club face dent, "Δ" for perceivable club face dent, but no fluff on the cover surface, and "X" for scraped surface with perceivable fluff.

Surface Roughening

Burrs on the ball as injection molded were trimmed and polished by means of a surface polisher. Surface roughness was visually evaluated.

TABLE 3

| | | | Example | | | | | | | | | |
|---|---|---|---|---|---|---|---|---|---|---|---|---|
| | | | 1 | 2 | 3 | 4 | 5 | 6 | 7 | 8 | 9 | 10 |
| | | Ion | | | | | | | | | | |
| Cover resin composition (pbw) | Surlyn AD8542 | Mg | 10 | 25 | 50 | 75 | 90 | 10 | 25 | 50 | 75 | 90 |
| | Himilan AM7311 | Mg | 90 | 75 | 50 | 25 | 10 | 45 | 37.5 | 25 | 12.5 | 5 |
| | Nucrel 1560 | | | | | | | 45 | 37.5 | 25 | 12.5 | 5 |
| Cover properties | Shore D hardness | | 59 | 56 | 53 | 48 | 46 | 60 | 57 | 54 | 49 | 46 |
| | MFR | | 0.7 | 0.8 | 0.8 | 0.9 | 1.0 | 5.9 | 4.9 | 3.7 | 1.8 | 1.6 |
| Ball properties | Ball hardness (mm) | | 2.5 | 2.5 | 2.7 | 2.8 | 3.0 | 2.4 | 2.5 | 2.6 | 2.8 | 2.9 |
| | Hitting feel | | Δ | ○ | ○ | ○ | ○ | Δ | ○ | ○ | ○ | ○ |
| | Initial velocity (m/s) | | 77.6 | 77.3 | 77.1 | 76.8 | 76.7 | 77.6 | 77.4 | 77.2 | 76.9 | 76.7 |
| | Scuffing by iron | | Δ | ○ | ○ | ○ | ○ | Δ | ○ | ○ | ○ | ○ |
| | Surface roughening | | nil | nil | nil | nil | nil | nil | nil | nil | nil | nil |

TABLE 4

| | | | Comparative Example | | | | | | | | | |
|---|---|---|---|---|---|---|---|---|---|---|---|---|
| | | | 1 | 2 | 3 | 4 | 5 | 6 | 7 | 8 | 9 | 10 |
| | | Ion | | | | | | | | | | |
| Cover resin composition (pbw) | Surlyn AD8542 | Mg | | 100 | | 50 | 50 | 50 | | | | |
| | Surlyn 9320 | Zn | | | 50 | | | | 50 | | | 50 |
| | Surlyn 8320 | Na | | | | | | | | 50 | 50 | |
| | Himilan AM7311 | Mg | 100 | | | | | | 50 | 50 | | |
| | Surlyn 7930 | Li | | | | 50 | | | | | | |
| | Himilan 1706 | Zn | | | | | | 50 | | | | 50 |
| | Himilan 1605 | Na | | | 50 | | 50 | | | | 50 | |
| Cover properties | Shore D hardness | | 63 | 44 | 53 | 55 | 55 | 54 | 54 | 53 | 52 | 51 |
| | MFR | | 0.7 | 1.0 | 1.9 | 1.7 | 1.9 | 1.0 | 0.8 | 0.8 | 1.9 | 0.9 |
| Ball properties | Ball hardness (mm) | | 2.3 | 3.0 | 2.7 | 2.7 | 2.7 | 2.7 | 2.7 | 2.7 | 2.6 | 2.7 |
| | Hitting feel | | X | X | ○ | ○ | ○ | ○ | ○ | ○ | ○ | ○ |
| | Initial velocity (m/s) | | 77.8 | 76.5 | 76.9 | 77.2 | 77.1 | 77.0 | 77.0 | 76.9 | 76.8 | 76.7 |
| | Scuffing by iron | | X | Δ | X | X | X | X | X | X | Δ | Δ |
| | Surface roughening | | nil | nil | rough | rough | rough | rough | rough | rough | nil | nil |

Note:

(1) Surlyn AD8542: magnesium ion neutralized ionomer of ethylene-methacrylic acid-acrylate terpolymer, Shore D hardness 44, MFR 1, by E. I. duPont de Nemours Co.

(2) Himilan AM7311: magnesium ion neutralized ionomer of ethylene-methacrylic acid copolymer, Shore D hardness 62, MFR 0.7, by Mitsui-duPont Polychemical K.K.

(3) Nucrel 1560: ethylene-methacrylic acid copolymer (base polymer of Himilan AM7311), Shore D hardness 50, MFR 60, by Mitsui-duPont Polychemical K.K.

(4) Surlyn 7930: lithium ion neutralized ionomer of ethylene-methacrylic acid copolymer, Shore D hardness 63, MFR 2.4, by E. I. duPont de Nemours Co.

(5) Himilan 1706: zinc ion neutralized ionomer of ethylene-methacrylic acid copolymer, Shore D hardness 60, MFR 0.9, by Mitsui-duPont Polychemical K.K.

(6) Himilan 1605: sodium ion neutralized ionomer of ethylene-methacrylic acid copolymer, Shore D hardness 61, MFR 2.8, by Mitsui-duPont Polychemical K.K.

(7) Surlyn 9320: zinc ion neutralized ionomer of ethylene-methacrylic acid-acrylate terpolymer, Shore D hardness 42, MFR 1, by E. I. duPont de Nemours Co.

(8) Surlyn 8320: sodium ion neutralized ionomer of ethylene-methacrylic acid-acrylate terpolymer, Shore D hardness 37, MFR 1.1, by E. I. duPont de Nemours Co.

It is evident from Tables 3 and 4 that golf balls within the scope of the invention offer an apparently high initial velocity and pleasant hitting feel. Since the soft and hard ionomer resins are of the same ion species, they are well compatible with each other, leading to an improvement in scuff resistance against iron shots and the elimination of surface roughening by polishing.

These advantages are maintained unchanged even when the magnesium ion neutralized ionomer of ethylene-(meth) acrylic acid copolymer is diluted with its base polymer to reduce the degree of neutralization for the purpose of increasing the MFR.

There has been described a golf ball whose cover is formed of a blend of a soft ionomer in the form of a magnesium ion neutralized ethylene/(meth)acrylic acid/ acrylate terpolymer and a hard ionomer in the form of a magnesium ion neutralized ethylene/(meth)acrylic acid copolymer. The golf ball is minimized in restitution loss while it offers a high initial velocity, pleasant hitting feel, spin susceptibility, and scuff resistance upon iron shots.

Japanese Patent Application No. 175517/1996 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A golf ball comprising; a core and a cover, said cover predominantly comprising a blend of a first ionomer in the form of a magnesium ion neutralized ethylene/(meth)acrylic acid/acrylate terpolymer, a second ionomer in the form of a magnesium ion neutralized ethylene/(meth)acrylic acid copolymer, and an uneutralized ethylene/(meth)acrylic acid copolymer, said blend having a Shore D hardness in the range of 44 to 60.

2. The golf ball of claim 1 wherein said blend comprises 10 to 90% by weight of the first ionomer and 90 to 10% by weight of the second ionomer.

3. A golf ball according to claim 1 wherein said acrylate includes esters having about 4 to about 12 carbon atoms.

4. A golf ball according to claim 1 wherein said acrylate is a methyl acrylate.

5. A golf ball according to claim 1 wherein said acrylate is an ethyl acrylate.

6. A golf ball according to claim 1 wherein said acrylate is an isobutyl acrylate.

7. A golf ball according to claim 1 wherein said acrylate is a n-butyl acrylate.

8. A golf ball according to claim 1 wherein said acrylate is a 2-ethylhexyl acrylate.

9. A golf ball according to claim 1 wherein said (meth) acrylic acid is 5% to 15% by weight of the overall weight of the terpolymer.

10. A golf ball according to claim 1 wherein said (meth) acrylic acid is 7% to 12% by weight of the overall weight of the terpolymer.

11. A golf ball according to claim 1 wherein said acrylate is 5% to 45% by weight of the overall weight of the terpolymer.

12. A golf ball according to claim 1 wherein said acrylate is 8% to 30% by weight of the overall weight of the terpolymer.

13. A golf ball according to claim 1 wherein a degree of neutralization for neutralizing the terpolymer is 10% to 90% mol.

14. A golf ball according to claim 1 wherein a degree of neutralization for neutralizing the terpolymer is 30% to 80% mol.

15. A golf ball according to claim 1 wherein said (meth) acrylic is 10% to 20% by weight of the overall weight of the copolymer.

16. A golf ball according to claim 1 wherein said (meth) acrylate is 12% to 20% by weight of the overall weight of the copolymer.

17. A golf ball according to claim 1 wherein a degree of neutralization for neutralizing the copolymer is 10% to 70% mol.

18. A golf ball according to claim 1 wherein a degree of neutralization for neutralizing the copolymer is 15% to 60% mol.

19. A golf ball according to claim 1 wherein said single layer cover has a gauge of 1.0 mm to 2.5 mm.

20. A golf ball according to claim 1 wherein said single layer cover has a gauge of 1.2 mm to 2.1 mm.

* * * * *